US010450994B2

(12) United States Patent
Pursifull

(10) Patent No.: US 10,450,994 B2
(45) Date of Patent: Oct. 22, 2019

(54) METHOD AND SYSTEM FOR FUEL SYSTEM CONTROL

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 762 days.

(21) Appl. No.: 14/551,906

(22) Filed: Nov. 24, 2014

(65) Prior Publication Data

US 2016/0146146 A1 May 26, 2016

(51) Int. Cl.

| | |
|---|---|
| ***F02D 41/38*** | (2006.01) |
| ***F02D 41/30*** | (2006.01) |
| ***F02D 41/26*** | (2006.01) |
| *F02D 41/20* | (2006.01) |
| *F02D 41/22* | (2006.01) |

(52) U.S. Cl.

CPC ..... *F02D 41/3854* (2013.01); *F02D 41/26* (2013.01); *F02D 41/3082* (2013.01); *F02D 41/20* (2013.01); *F02D 2041/2048* (2013.01); *F02D 2041/2051* (2013.01); *F02D 2041/223* (2013.01); *F02D 2200/0602* (2013.01)

(58) Field of Classification Search

CPC ..... F02D 2041/2048; F02D 2041/2051; F02D 2041/223; F02D 2200/0602; F02D 41/20; F02D 41/26; F02D 41/3082; F02D 41/3854

USPC ..... 701/104

See application file for complete search history.

(56) References Cited

U.S. PATENT DOCUMENTS

| | | | | |
|---|---|---|---|---|
| 4,993,391 | A * | 2/1991 | Kuribara | F02D 19/0605 123/1 A |
| 5,515,830 | A * | 5/1996 | Arakowa | F02D 41/20 123/490 |
| 5,555,872 | A * | 9/1996 | Takeuchi | F02D 41/3082 123/198 D |
| 5,762,046 | A * | 6/1998 | Holmes | F02D 41/3082 123/497 |
| 6,332,454 | B1 * | 12/2001 | Itabashi | F02D 41/062 123/490 |
| 7,284,539 | B1 | 10/2007 | Fukasawa | |
| 7,640,916 | B2 | 1/2010 | Ulrey et al. | |
| 8,061,329 | B2 | 11/2011 | Pursifull et al. | |

(Continued)

OTHER PUBLICATIONS

Surnilla, Gopichandra et al., "Robust Direct Injection Fuel Pump System," U.S. Appl. No. 14/155,250, filed Jan. 14, 2014, 61 pages.

(Continued)

*Primary Examiner* — Carl C Staubach

(74) *Attorney, Agent, or Firm* — Julia Voutyras; McCoy Russell LLP

(57) ABSTRACT

Methods and systems are provided for enforcing a minimum fuel lift pump commanded voltage that is determined as a function of commanded lift pump pressure and fuel flow rate. The minimum fuel lift pump voltage is applied when the commanded voltage is lower than the minimum voltage. The approach reduces engine stalls induced by ingestion of fuel vapors at an injection pump coupled downstream of the lift pump.

7 Claims, 7 Drawing Sheets

(56) References Cited

U.S. PATENT DOCUMENTS

| | | | | |
|---|---|---|---|---|
| 2004/0031467 | A1* | 2/2004 | Bernhardt | F04B 49/225 123/446 |
| 2008/0245343 | A1* | 10/2008 | Graf | F02D 41/3082 123/497 |
| 2009/0090331 | A1 | 4/2009 | Pursifull | |
| 2013/0144507 | A1* | 6/2013 | Lee | F02D 41/3082 701/103 |
| 2014/0121949 | A1* | 5/2014 | Song | F02D 41/126 701/104 |
| 2014/0224217 | A1 | 8/2014 | Pursifull et al. | |
| 2015/0377174 | A1* | 12/2015 | Aso | F02D 41/3845 123/497 |
| 2016/0153383 | A1* | 6/2016 | Ulrey | F02D 41/3082 123/458 |
| 2016/0153388 | A1* | 6/2016 | Sanborn | F02M 39/00 123/458 |
| 2016/0356237 | A1* | 12/2016 | Pursifull | F02D 41/3082 |

OTHER PUBLICATIONS

Ulrey, Joseph N. et al., "Current Pulsing Control Methods for Lift Fuel Pumps," U.S. Appl. No. 14/444,739, filed Jul. 28, 2014, 48 pages.

* cited by examiner

METHOD AND SYSTEM FOR FUEL SYSTEM CONTROL

FIELD

The field of the disclosure generally relates to fuel systems in internal combustion engines.

BACKGROUND AND SUMMARY

Lift pump control systems may be used for a variety of fuel system control purposes. These may include, for example, vapor management, injection pressure control, temperature control, and lubrication. In one example, a lift pump supplies fuel to a high pressure fuel pump that provides a high injection pressure for direct injectors in an internal combustion engine. The high pressure fuel pump may provide the high injection pressure by supplying high pressure fuel to a fuel rail to which the direct injectors are coupled. A fuel pressure sensor may be disposed in the fuel rail to enable measurement of the fuel rail pressure, on which various aspects of engine operation may be based, such as fuel injection.

However, the inventors herein have identified potential issues with such systems. Lift pump pressure sensors may degrade. In particular, they may fail in-range while reading a higher pressure than actually is present. As a result, the closed loop pressure control system may drop that pumped voltage in response to the pressure sensor output reading falsely high. The lowered lift pump voltage has a commensurate drop in lift pump pressure. In particular, the lift pump pressure may drop below the fuel vapor pressure. Since the lift pump pressure is the same as the inlet pressure of the downstream high pressure fuel pump, the drop in lift pump pressure below the fuel vapor pressure results in the high pressure fuel pump sucking in fuel vapor. The presence of fuel vapors at the pump inlet of the high pressure fuel pump can result in a precipitous drop in fuel rail pressure, causing the engine to stall.

In one example, the above issues may be addressed by a method comprising: adjusting fuel lift pump operation in response to a lift pump pressure sensor downstream of the lift pump and upstream of a high pressure pump; and operating the lift pump with a minimum lift pump voltage when a commanded lift pump voltage is below the minimum lift pump voltage. In this way, at least a minimum pressure may be maintained downstream of the lift pump under all pump operating conditions.

In one example, a fuel system includes a lift pump for delivering fuel from the fuel tank to a high pressure fuel pump. The high pressure fuel pump may be coupled to a fuel rail delivering fuel to cylinder direct fuel injectors. The lift pump may be operated predominantly in a continuous power mode. Therein, based on a fuel pressure and fuel flow rate required to meet the fueling demand, a voltage (or speed, current, duty cycle, torque, or power) applied to the lift pump may be determined. For example, as the commanded fuel pressure increases, the command and pump voltage may also be increased, and likewise, as the commanded fuel pressure decreases, the commanded pump voltage may also decrease. However, a minimum clip may be applied to the pump voltage to enforce a minimum lift pump pressure. The minimum pressure, and corresponding minimum pump voltage, may be determined based on fuel vapor pressure and fuel flow rate. In other words, if the commanded pump voltage is below the minimum pump voltage, a controller may override the commanded pump voltage and apply the minimum pump voltage instead. Since the lift pump pressure is controlled in a closed loop manner with a PID controller, during the clipping, the integral term may be transiently frozen or reset (e.g., to zero). The lift pump may additionally be operated in a pulsed mode wherein lift pump voltage is adjusted based on lift pump pressure estimated by a lift pump pressure sensor. However, by applying the minimum pump voltage during conditions when the commanded pump voltage is lower, the potential for fuel vapor generation at the inlet of the high pressure pump is reduced. This, in turn, reduces the need for frequent lift pump pulsing.

In this way, a low voltage clip is applied to a lift pump command to ensure that the fuel system always makes a minimum pressure. As such this ensures a basic function of the pump system. By enforcing a minimum voltage on the lift pump that is a function of the commanded lift pump pressure, the closed loop controller may account for pump degradation. In addition, fuel system operation is improved even during conditions when a lift pump pressure sensor output is unreliable. Overall, engine stalls due to ingestion of vapor pressure at a high pressure fuel pump inlet is reduced. Further, by reducing the need for frequent lift pump pulsing, fuel system energy consumption is reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
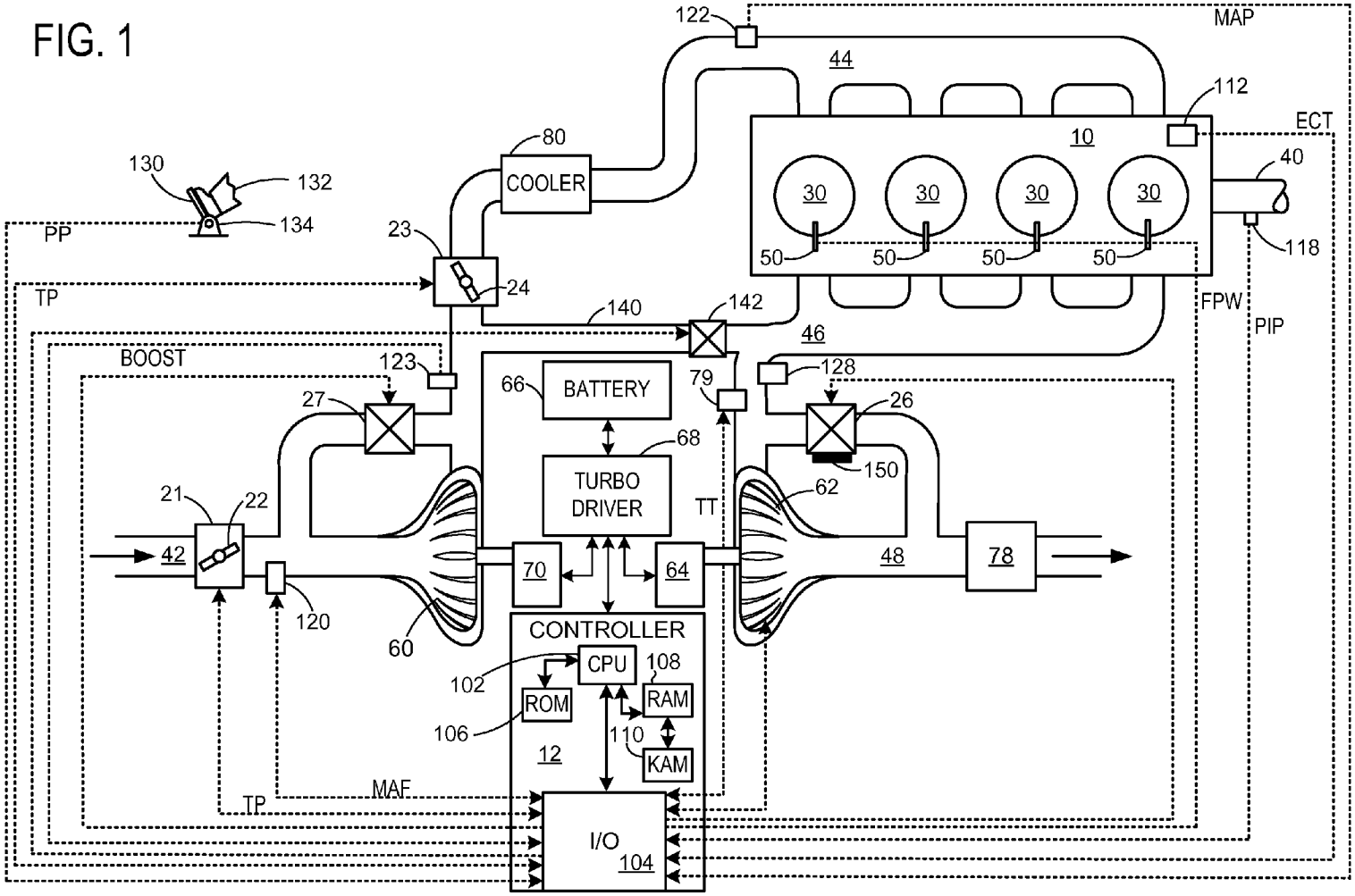
FIG. 1 is a schematic diagram showing an example engine.
Figure 2:
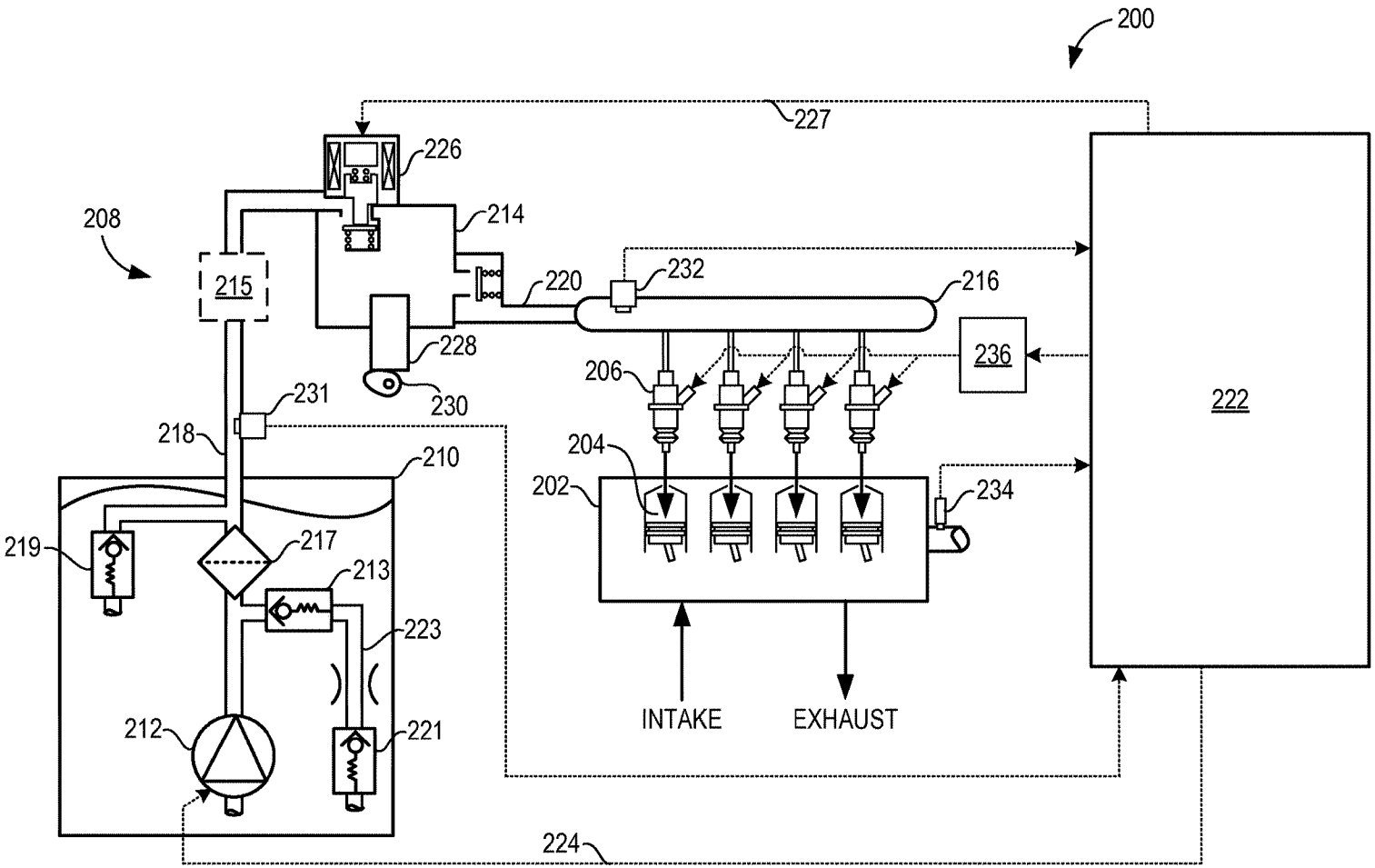
FIG. 2 shows a direct injection engine system.
Figure 3:
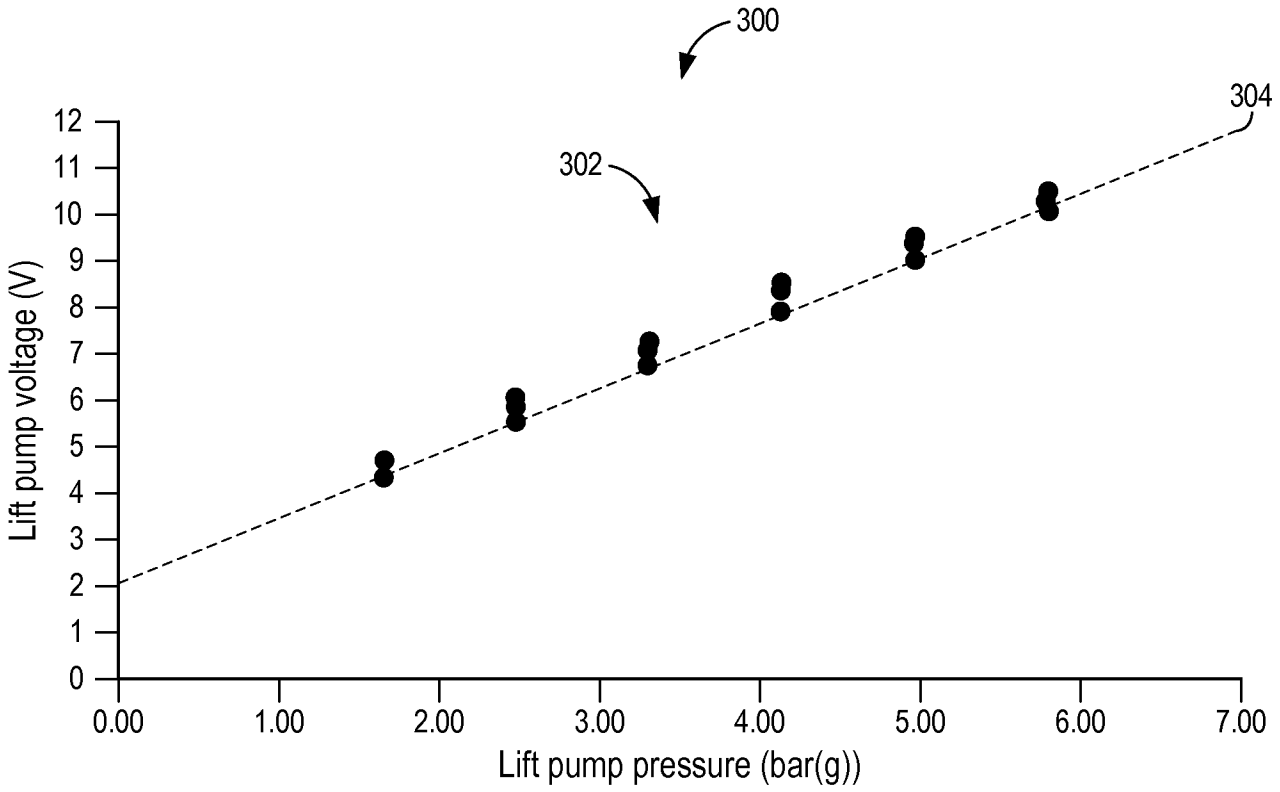
FIG. 3 shows a graph illustrating lift pump voltage as a function of lift pump pressure.
Figure 4:
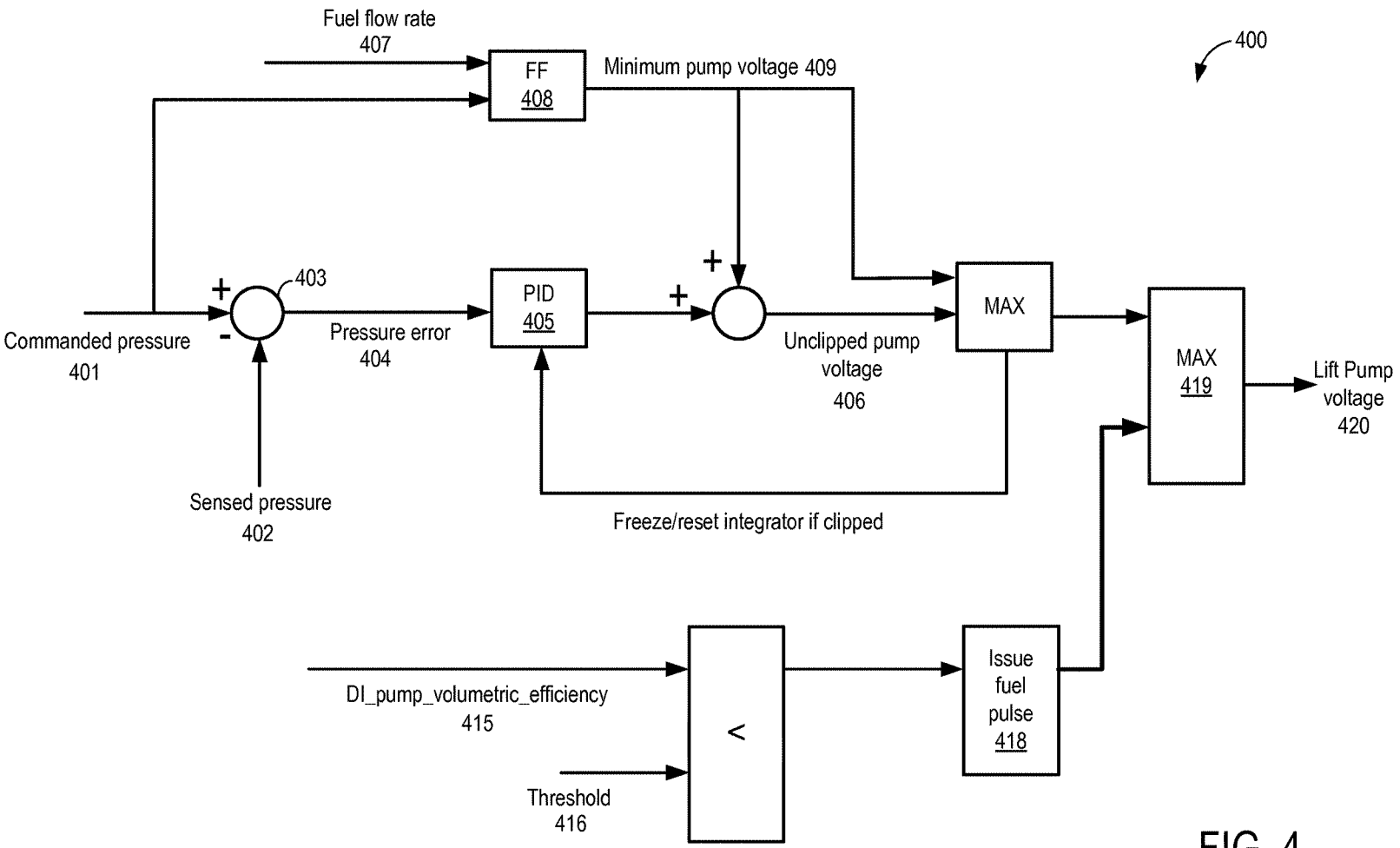
FIG. 4 shows an example block diagram of closed-loop control of a lift pump voltage command, according to the present disclosure.

Methods and systems are provided for improving closed-loop lift pump pressure control in engines having fuel systems where a low pressure (LP) fuel lift pump draws pressurized fuel from a fuel tank and supplies the pressurized fuel to a high pressure (HP) fuel pump, as shown in FIGS. 1-2. The high pressure fuel pump may further raise the pressure of the pressurized fuel to a level sufficient for directly injecting fuel into the engine cylinders. A lift pump voltage may be commanded to provide a desired lift pump pressure, as shown in FIG. 3. To reduce fueling errors and potential engine stalls caused due to a falsely high output from a lift pump pressure sensor, a controller may clip the commanded lift pump voltage on the lower end during closed-loop fuel pump output control (FIG. 4). For example, the controller may be configured to perform a routine, such as the routine of FIG. 5, to apply a minimum pump voltage during conditions when the commanded lift pump voltage is below the minimum pump voltage. As a result, lift pump pressure and high pressure fuel pump inlet pressure may be maintained above a fuel vapor pressure. An example lift pump voltage adjustment is shown with a reference to FIG. 6. An example change in pump pressure resulting from a fuel rail pressure sensor fault is shown at FIG. 7. In this way, engine stalls are reduced.

FIG. 1 is a schematic diagram showing an example engine 10, which may be included in a propulsion system of an automobile. The engine 10 is shown with four cylinders 30. However, other numbers of cylinders may be used in accordance with the current disclosure. Engine 10 may be controlled at least partially by a control system including controller 12, and by input from a vehicle operator 132 via an input device 130. In this example, input device 130 includes an accelerator pedal and a pedal position sensor 134 for generating a proportional pedal position signal PP. Each combustion chamber (e.g., cylinder) 30 of engine 10 may include combustion chamber walls with a piston (not shown) positioned therein. The pistons may be coupled to a crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel to enable a starting operation of engine 10.

Combustion chambers 30 may receive intake air from intake manifold 44 via intake passage 42 and may exhaust combustion gasses via exhaust passage 48. Intake manifold 44 and exhaust manifold 46 can selectively communicate with combustion chamber 30 via respective intake valves and exhaust valves (not shown). In some embodiments, combustion chamber 30 may include two or more intake valves and/or two or more exhaust valves.

Fuel injectors 50 are shown coupled directly to combustion chamber 30 for injecting fuel directly therein in proportion to the pulse width of signal FPW received from controller 12. In this manner, fuel injector 50 provides what is known as direct injection of fuel into combustion chamber 30. The fuel injector may be mounted in the side of the combustion chamber or in the top of the combustion chamber, for example. Fuel may be delivered to fuel injector 50 by a fuel system (not shown) including a fuel tank, a fuel pump, and a fuel rail. An example fuel system that may be employed in conjunction with engine 10 is described below with reference to FIG. 2. In some embodiments, combustion chambers 30 may alternatively, or additionally, include a fuel injector arranged in intake manifold 44 in a configuration that provides what is known as port injection of fuel into the intake port upstream from each combustion chamber 30.

Intake passage 42 may include throttle 21 and 23 having throttle plates 22 and 24, respectively. In this particular example, the position of throttle plates 22 and 24 may be varied by controller 12 via signals provided to an actuator included with throttles 21 and 23. In one example, the actuators may be electric actuators (e.g., electric motors), a configuration that is commonly referred to as electronic throttle control (ETC). In this manner, throttles 21 and 23 may be operated to vary the intake air provided to combustion chamber 30 among other engine cylinders. The position of throttle plates 22 and 24 may be provided to controller 12 by throttle position signal TP. Intake passage 42 may further include a mass air flow sensor 120, a manifold air pressure sensor 122, and a throttle inlet pressure sensor 123 for providing respective signals MAF (mass airflow) MAP (manifold air pressure) to controller 12.

Exhaust passage 48 may receive exhaust gasses from cylinders 30. Exhaust gas sensor 128 is shown coupled to exhaust passage 48 upstream of turbine 62 and emission control device 78. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO, a NOx, HC, or CO sensor, for example. Emission control device 78 may be a three way catalyst (TWC), NOx trap, various other emission control devices, or combinations thereof.

Exhaust temperature may be measured by one or more temperature sensors (not shown) located in exhaust passage 48. Alternatively, exhaust temperature may be inferred based on engine operating conditions such as speed, load, AFR, spark retard, etc.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112, shown schematically in one location within the engine 10; a profile ignition pickup signal (PIP) from Hall effect sensor 118 (or other type) coupled to crankshaft 40; the throttle position (TP) from a throttle position sensor, as discussed; and absolute manifold pressure signal, MAP, from sensor 122, as discussed. Engine speed signal, RPM, may be generated by controller 12 from signal PIP. Manifold pressure signal MAP from a manifold pressure sensor may be used to provide an indication of vacuum, or pressure, in the intake manifold 44. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft 40. In some examples, storage medium read-only memory 106 may be programmed with computer readable data representing instructions executable by processor 102 for performing the methods described below as well as other variants that are anticipated but not specifically listed.

Engine 10 may further include a compression device such as a turbocharger or supercharger including at least a compressor 60 arranged along intake manifold 44. For a turbocharger, compressor 60 may be at least partially driven by a turbine 62, via, for example a shaft, or other coupling arrangement. The turbine 62 may be arranged along exhaust passage 48 and communicate with exhaust gasses flowing there-through. Various arrangements may be provided to drive the compressor. For a supercharger, compressor 60 may be at least partially driven by the engine and/or an electric machine, and may not include a turbine. Thus, the amount of compression provided to one or more cylinders of the engine via a turbocharger or supercharger may be varied by controller 12. In some cases, the turbine 62 may drive, for example, an electric generator 64, to provide power to a battery 66 via a turbo driver 68. Power from the battery 66 may then be used to drive the compressor 60 via a motor 70. Further, a sensor 123 may be disposed in intake manifold 44 for providing a BOOST signal to controller 12.

Further, exhaust passage 48 may include wastegate 26 for diverting exhaust gas away from turbine 62. In some embodiments, wastegate 26 may be a multi-staged wastegate, such as a two-staged wastegate with a first stage configured to control boost pressure and a second stage configured to increase heat flux to emission control device 78. Wastegate 26 may be operated with an actuator 150, which may be an electric actuator such as an electric motor, for example, though pneumatic actuators are also contemplated. Intake passage 42 may include a compressor bypass valve 27 configured to divert intake air around compressor 60. Wastegate 26 and/or compressor bypass valve 27 may be controlled by controller 12 via actuators (e.g., actuator 150) to be opened when a lower boost pressure is desired, for example.

Intake passage 42 may further include charge air cooler (CAC) 80 (e.g., an intercooler) to decrease the temperature of the turbocharged or supercharged intake gasses. In some embodiments, charge air cooler 80 may be an air to air heat exchanger. In other embodiments, charge air cooler 80 may be an air to liquid heat exchanger.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor (not shown) may be arranged within the EGR passage and may provide an indication of one or more of pressure, temperature, and concentration of the exhaust gas. Alternatively, the EGR may be controlled through a calculated value based on signals from the MAF sensor (upstream), MAP (intake manifold), MAT (manifold gas temperature) and the crank speed sensor. Further, the EGR may be controlled based on an exhaust $O_2$ sensor and/or an intake oxygen sensor (intake manifold). Under some conditions, the EGR system may be used to regulate the temperature of the air and fuel mixture within the combustion chamber. FIG. 1 shows a high pressure EGR system where EGR is routed from upstream of a turbine of a turbocharger to downstream of a compressor of a turbocharger. In other embodiments, the engine may additionally or alternatively include a low pressure EGR system where EGR is routed from downstream of a turbine of a turbocharger to upstream of a compressor of the turbocharger.

FIG. 2 shows a direct injection engine system 200, which may be configured as a propulsion system for a vehicle. The engine system 200 includes an internal combustion engine 202 having multiple combustion chambers or cylinders 204. Engine 202 may be engine 10 of FIG. 1, for example. Fuel can be provided directly to the cylinders 204 via in-cylinder direct injectors 206. As indicated schematically in FIG. 2, the engine 202 can receive intake air and exhaust products of the combusted fuel. The engine 202 may include a suitable type of engine including a gasoline or diesel engine.

Fuel can be provided to the engine 202 via the injectors 206 by way of a fuel system indicated generally at 208. In this particular example, the fuel system 208 includes a fuel storage tank 210 for storing the fuel on-board the vehicle, a lower pressure fuel pump 212 (e.g., a fuel lift pump), a higher pressure fuel pump 214, an accumulator 215, a fuel rail 216, and various fuel passages 218 and 220. In the example shown in FIG. 2, the fuel passage 218 carries fuel from the lower pressure pump 212 to the higher pressure fuel pump 214, and the fuel passage 220 carries fuel from the higher pressure fuel pump 214 to the fuel rail 216.

The lower pressure fuel pump 212 can be operated by a controller 222 (e.g., controller 12 of FIG. 1) to provide fuel to higher pressure fuel pump 214 via fuel passage 218. The lower pressure fuel pump 212 can be configured as what may be referred to as a fuel lift pump. As one example, lower pressure fuel pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 reduces the electrical power that is provided to pump 212, the volumetric flow rate and/or pressure increase across the pump may be reduced. The volumetric flow rate and/or pressure increase across the pump may be increased by increasing the electrical power that is provided to the pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, as indicated at 224, the flow rate and pressure of the fuel provided to higher pressure fuel pump 214 and ultimately to the fuel rail may be adjusted by the controller 222. In addition to providing injection pressure for direct injectors 206, pump 212 may provide injection pressure for one or more port fuel injectors (not shown in FIG. 2) in some implementations.

Low-pressure fuel pump 212 may be fluidly coupled to a filter 217, which may remove small impurities that may be contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar (g). An orifice check valve 221 may be placed in series with an orifice 223 to allow for air and/or fuel vapor to bleed out of the lift pump 212. In some embodiments, fuel system 208 may include one or more (e.g., a series) of check valves fluidly coupled to low-pressure fuel pump 212 to impede fuel from leaking back upstream of the valves. In this context, upstream flow refers to fuel flow traveling from fuel rail 216 towards low-pressure pump 212 while downstream flow refers to the nominal fuel flow direction from the low-pressure pump towards the fuel rail.

The higher pressure fuel pump 214 can be controlled by the controller 222 to provide fuel to the fuel rail 216 via the fuel passage 220. As one non-limiting example, higher pressure fuel pump 214 may be a BOSCH HDP5 HIGH PRESSURE PUMP, which utilizes a flow control valve (e.g., fuel volume regulator, magnetic solenoid valve, etc.) 226 to enable the control system to vary the effective pump volume of each pump stroke, as indicated at 227. However, it should be appreciated that other suitable higher pressure fuel pumps may be used. The higher pressure fuel pump 214 may be mechanically driven by the engine 202 in contrast to the motor driven lower pressure fuel pump 212. A pump piston 228 of the higher pressure fuel pump 214 can receive a mechanical input from the engine crank shaft or cam shaft via a cam 230. In this manner, higher pressure pump 214 can be operated according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. In some examples, higher pressure fuel pump 214 may supply sufficiently high fuel pressure to injectors 206. As injectors 206 may be configured as direct fuel injectors, higher pressure fuel pump 214 may be referred to as a direct injection (DI) fuel pump.

FIG. 2 depicts the optional inclusion of accumulator 215, introduced above. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. The volume of accumulator 215 may be sized such that engine 202 can operate at idle conditions for a predetermined period of time between operating intervals of lower pressure fuel pump 212. For example, accumulator 215 can be sized such that when engine 202 idles, it takes one or more minutes to deplete pressure in the accumulator to a level at which higher pressure fuel pump 214 is incapable of maintaining a sufficiently high fuel pressure for fuel injectors 206. Accumulator 215 may thus enable an intermittent operation mode of lower pressure fuel pump 212 described below. In other embodiments, accumulator 215 may inherently exist in the compliance of fuel filter 217 and fuel line 218, and thus may not exist as a distinct element.

The controller 222 can individually actuate each of the injectors 206 via a fuel injection driver 236. The controller 222, the driver 236, and other suitable engine system controllers can comprise a control system. While the driver 236 is shown external to the controller 222, it should be appreciated that in other examples, the controller 222 can include the driver 236 or can be configured to provide the functionality of the driver 236. Controller 222 may include additional components not shown, such as those included in controller 12 of FIG. 1.

Fuel system 208 includes a low pressure (LP) fuel pressure sensor 231 positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. As described in further detail below, readings from sensor 231 may be used to control the voltage applied to the lift pump in a closed-loop manner. Specifically, LP fuel pressure sensor 231 may be used to determine whether sufficient fuel pressure is provided to higher pressure fuel pump 214 so that the higher pressure fuel pump ingests liquid fuel and not fuel vapor, and/or to minimize the average electrical power supplied to lift pump 212. It will be understood that in other embodiments in which a port-fuel injection system, and not a direct injection system, is used, LP fuel pressure sensor 231 may sense both lift pump pressure and fuel injection. Further, while LP fuel pressure sensor 231 is shown as being positioned upstream of accumulator 215, in other embodiments the LP sensor may be positioned downstream of the accumulator.

As shown in FIG. 2, the fuel rail 216 includes a fuel rail pressure sensor 232 for providing an indication of fuel rail pressure to the controller 222. An engine speed sensor 234 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

As elaborated herein, controller 222 may determine a voltage to be applied to the lift pump based on the commanded fuel pressure. In addition, the controller may compute a minimum lift pump voltage to be applied based on the commanded lift pump pressure and the fuel flow rate. As used herein, the lift pump pressure is taken to be synonymous with the high pressure (DI) pump inlet pressure. The controller may use testing data or modeled data, such as the data of FIG. 3, to determine an equation that is used to compute the minimum lift pump voltage. The results may be stored in and retrieved from a look-up table upon query. As elaborated with reference to the lift pump control scheme of FIG. 4, the controller may override the adjustment from a lift pump pressure sensor when the sensor output results in a commanded lift pump voltage that is below the minimum voltage. Instead, the controller may apply the minimum voltage for the given operating conditions.

In some cases, controller 222 may also determine an expected or estimated fuel rail pressure and compare the expected fuel rail pressure to the measured fuel rail pressure measured by fuel rail pressure sensor 232. In other cases, controller 222 may determine an expected or estimated lift pump pressure (e.g., outlet fuel pressure from lift pump 212 and/or inlet fuel pressure into higher pressure fuel pump 214) and compare the expected lift pump pressure to the measured lift pump pressure measured by LP fuel pressure sensor 231. The determination and comparison of expected fuel pressures to corresponding measured fuel pressures may be performed periodically on a time basis at a suitable frequency or on an event basis.

Turning briefly to FIG. 3, a graph 300 illustrating lift pump voltage as a function of lift pump pressure is shown. Graph 300 particularly shows the highly affine correlation between the voltage supplied to a turbine lift pump (e.g., lift pump 212) driven by a DC electric motor and the lift pump pressure. An example data set generally indicated at 302, obtained in a testing environment specific to this type of lift pump, for example, and a function 304 fit to the data set are shown in graph 300. The data shown in graph 300 represents a minimum engine running fuel flow rate. As the fuel flow rate increases, the points increase in voltage. Function 304 may be stored in and accessed by controller 222 of FIG. 2 to inform control of fuel system 208—for example, a desired lift pump pressure may be fed to function 304 as an input so that a lift pump minimum voltage, whose application to lift pump 212 achieves the desired lift pump pressure, may be obtained. In particular, function 304 may be used to determine the lift pump voltages that achieve the extreme lift pump pressures—that is, the minimum and maximum achievable lift pump pressures. As described in further detail below, the lift pump voltages may be clipped with higher and/or lower clips during selected conditions to improve the closed-loop control of the lift pump pressure. A block diagram of the closed-loop control routine is shown at FIG. 4. In an alternate example, if the voltage being supplied to lift pump 212 is known, it may be fed as an input to the function so that an expected or estimated lift pump pressure resulting from application of the supply voltage can be determined.

It will be understood that the lift pump pressure minima and maxima may be bounded by fuel vapor pressure and a set-point pressure of a pressure relief valve, respectively. It will also be appreciated that the values displayed in FIG. 3 are examples and are not intended to be limiting. Further, analogous data sets and functions relating lift pump pressure to lift pump voltage may be obtained and accessed for lift pump types other than turbine lift pumps driven by DC electric motors, including but not limited to positive displacement pumps and pumps driven by brushless motors. Such functions may assume linear or non-linear forms.

Returning to FIG. 2, determination of the expected lift pump pressure may also account for operation of fuel injectors 206 and/or higher pressure fuel pump 214. Particularly, the effects of these components on lift pump pressure may be parameterized by the fuel flow rate—e.g., the rate at which fuel is injected by injectors 206, which may be equal to the lift pump flow rate under steady state conditions. In some implementations, a linear relation may be formed between lift pump voltage, lift pump pressure, and fuel flow rate. As a non-limiting example, the relation may assume the following form: $V_{LP}=C_1*P_{LP}+C_2*F+C_3$, where $V_{LP}$ is the lift pump voltage, $P_{LP}$ is the lift pump pressure, F is the fuel flow rate, and $C_1$, $C_2$, and $C_3$ are constants which may respectively assume the values of 1.481, 0.026, and 2.147. In this example, the relation may be accessed to determine a lift pump supply voltage whose application results in a desired lift pump pressure and fuel flow rate. The relation may be stored in (e.g., via a lookup table) and accessed by controller 222, for example.

The expected fuel rail pressure in fuel rail 216 may be determined based on one or more operating parameters—for example, one or more of an assessment of fuel consumption (e.g., fuel flow rate, fuel injection rate), fuel temperature (e.g., via engine coolant temperature measurement), and lift pump pressure (e.g., as measured by LP fuel pressure sensor 231) may be used.

In some embodiments, controller 222 can compare the expected fuel pressure to the corresponding measured fuel pressure and interpret differences between the expected and measured pressures that are above a threshold difference as an indication of degradation in fuel system 208. In particular, a measured fuel rail pressure measured by fuel rail pressure sensor 232 may be compared to an expected fuel rail pressure, while a measured lift pump pressure measured by LP fuel pressure sensor 231 may be compared to an expected lift pump pressure. If, for example, controller 222 determines that the measured fuel rail pressure exceeds the expected fuel rail pressure by at least a threshold amount, the controller may interpret the difference as an indication that fuel rail pressure sensor 232 has degraded.

The inventors herein have recognized that the lift pump pressure sensor can degraded in-range. As a result, it may output a higher lift pump pressure reading than is actually present (herein also referred to as a false high). As a result of the false high reading, the closed loop pressure control of the lift pump pressure moves to dropping the lift pump voltage. The lowered pump voltage has a commensurate drop in lift pump pressure, as shown at FIG. 3. If the lift pump pressure is dropped to below the fuel vapor pressure in response to the false high reading, the high pressure DI pump may start to ingest fuel vapors. This can result in an eventual engine stall due to the faulted pressure sensor. An engine stall risk may be acceptable during the case of a faulted pressure sensor. As such, if the fuel pressure were too high (e.g., higher than actual due to the lift pressure sensor reading a false low), the risks involved would include increased electrical power consumption and degraded lift pump durability. However, these risks may be acceptable during the case of a faulted pressure sensor. As elaborated at FIGS. 4-5, to reduce the possibility of an engine stall induced by the pressure sensor reading a false high, the controller may implement a minimum clip on lift pump voltage during the closed loop pressure control. The minimum voltage clip may allow the lift pump voltage command to be maintained at a minimum level even voltage lower voltage would otherwise be commanded. In doing so, the lift pump operation may be maintained at a minimum level, allowing the engine to run, even if the pressure is below target. As such, the target lift pump pressure is determined in an open loop manner without knowledge of actual fuel volatility and with some uncertainty in actual fuel temperature. Thus, it is likely that the target pressure is higher than actually required.

As alluded to above, the inclusion of accumulator 215 in fuel system 208 may enable intermittent operation of lift pump 212, at least during selected conditions. Intermittently operating lift pump 212 may include turning the pump on and off, where during off periods the pump speed falls to zero, for example. Intermittent lift pump operation may be employed to maintain the efficiency of higher pressure fuel pump 214 at a desired level, to maintain the efficiency of lift pump 212 at a desired level, and/or to reduce unnecessary energy consumption of lift pump 212. The efficiency (e.g., volumetric) of higher pressure fuel pump 214 may be at least partially parameterized by the fuel pressure at its inlet; as such, intermittent lift pump operation may be selected according to this inlet pressure, as this pressure may partially determine the efficiency of pump 214. The inlet pressure of higher pressure fuel pump 214 may be determined via LP fuel pressure sensor 231, or may be inferred based on various operating parameters. In other examples, the efficiency of pump 214 may be predicted based on the rate of fuel consumption by engine 202. The duration for which lift pump 212 is driven may be related to maintaining the inlet pressure of pump 214 above fuel vapor pressure, for example. On the other hand, lift pump 212 may be deactivated according to the amount of fuel (e.g., fuel volume) pumped to accumulator 215; for example, the lift pump may be deactivated when the amount of fuel pumped to the accumulator exceeds the volume of the accumulator by a predetermined amount (e.g., 20%). In other examples, lift pump 212 may be deactivated when the pressure in accumulator 215 or the inlet pressure of higher pressure fuel pump 214 exceed respective threshold pressures.

In some implementations, the operating mode of lift pump 212 may be selected according to the instant speed and/or load of engine 202. A suitable data structure such as a lookup table may store the operating modes which may be accessed by using engine speed and/or load as indices into the data structure, which may be stored on and accessed by controller 222, for example. The intermittent operating mode in particular may be selected for relatively lower engine speeds and/or loads. During these conditions, fuel flow to engine 202 is relatively low and lift pump 212 has capacity to supply fuel at a rate that is higher than the engine's fuel consumption rate. Therefore, lift pump 212 can fill accumulator 215 and then be turned off while engine 202 continues to operate (e.g., combusting air-fuel mixtures) for a period before the lift pump is restarted. Restarting lift pump 212 replenishes fuel in accumulator 215 that was fed to engine 202 while the lift pump was off.

During relatively higher engine speeds and/or loads, lift pump 212 may be operated continuously. In one embodiment, lift pump 212 is operated continuously when the lift pump cannot exceed the engine fuel flow rate by an amount (e.g., 25%) when the pump is operated at an "on" duty cycle (e.g., 75%) for a period of time (e.g., 1.5 minutes). However, if desired, the "on" duty cycle level that triggers continuous lift pump operation may be adjusted to various suitable percentages (e.g., 35%, 40%, 45%, 50%, 55%, 60%, 65%, 70%, etc.).

In the continuous operating mode, lift pump 212 may be operated at a substantially constant voltage (e.g., 12V+/−0.2V), or the supply voltage may be modulated such that the pump speed can be controlled to deliver a desired pressure at the inlet of higher pressure fuel pump 214. If the supply voltage to lift pump 212 is modulated, the lift pump turns continuously without stopping between voltage pulses. Providing a narrowly spaced pulse train of voltage allows controller 222 to control pump flow so that lift pump flow essentially matches the amount of fuel being injected into engine 202. This operation can be accomplished by setting the lift pump duty cycle as a function of engine speed and load, for example. Alternatively, the average supply voltage to lift pump 212 from the modulated voltage can be varied as the amount of fuel supplied to engine 202 varies. In other embodiments, a controlled current output may be used to supply current to lift pump 212. The amount of current supplied to lift pump 212 can be varied with engine speed and load, for example.

Now turning to FIG. 4, an example control scheme 400 is shown for closed-loop adjusting a lift pump voltage based on a commanded lift pump pressure. The control scheme includes the implementation of a minimum clip on lift pump voltage to reduce the risk of engine stall events that can be induced if a lift pump pressure sensor reading is erroneous, and more specifically, falsely high. The approach of FIG. 4 lets the feedback add lift pump voltage but never reduce it. Thus one always gets the feed-forward voltage as the minimum lift pump voltage. If you allow lift pump voltage to be reduced, you risk a feedback pressure sensor that reads falsely high to lower lift pump voltage such that an engine stall can occur. Without this, the feedback controller would drive the lift pump voltage to implausibly low lift pump voltages. In addition, by pulsing the fuel pump when pump volumetric efficiency drops below a threshold, the strategy becomes fully robust.

Each of a commanded pressure (401) input and a sensed pressure (402) input are received at comparator 403. The commanded pressure 401 may be based on engine operating conditions such as engine speed and load. The sensed pressure 402 may be based on the output of the lift pump pressure sensor. A pressure error 404 may be estimated based on the comparison. For example, it may be determined if the actual pressure (that is, as sensed) is higher or lower than the commanded pressure. The pressure error 404 may be fed into a PID controller 405. In parallel, the commanded pressure 401 and the fuel flow rate 407 may be fed as inputs into a feed-forward controller 408 to determine a minimum lift pump voltage 409. The minimum lift pump voltage may represent the minimum voltage that needs to be applied to the lift pump to generate the commanded pressure at the given fuel flow rate. The output of the PID controller 405 is compared to the minimum pump voltage 409 to generate an unclipped pump voltage 406. A maximum (that is, larger) of the minimum pump voltage 409 and the unclipped pump voltage 406 is then input into another comparator, discussed below.

Also in parallel, the volumetric efficiency 415 of the DI pump is compared to a threshold 416. Based on the comparison, a fuel pulse is issued at 418. The fuel pulse is then compared to the maximum (that is, larger) of the minimum pump voltage 409 and the unclipped pump voltage 406 at comparator 419. Comparator 419 then takes the maximum (that is, larger of) the received inputs to generate the lift pump voltage 420 to be finally commanded to the lift pump. This includes selecting the unclipped lift pump voltage for implementation when the unclipped lift pump voltage is higher than the minimum lift pump voltage. This further includes, when the unclipped lift pump voltage is lower than the minimum lift pump voltage, overriding the sensed pressure input and applying the minimum lift pump voltage. Herein, the lift pump voltage generated based on the commanded pressure and sensed pressure is clipped, for example, due to the potential for the sensed pressure being higher than actual. Since the closed-loop control is implemented with a single minimum clip on lift pump voltage and a PID controller, the integral may wind up, with a subsequent deleterious delay during unwind, over the duration of the clipping. To reduce this delay, the integral term (I) may be frozen during the clipping. Alternatively, the integral term may be reset (e.g., to zero) during the clipping.

Figure 5:
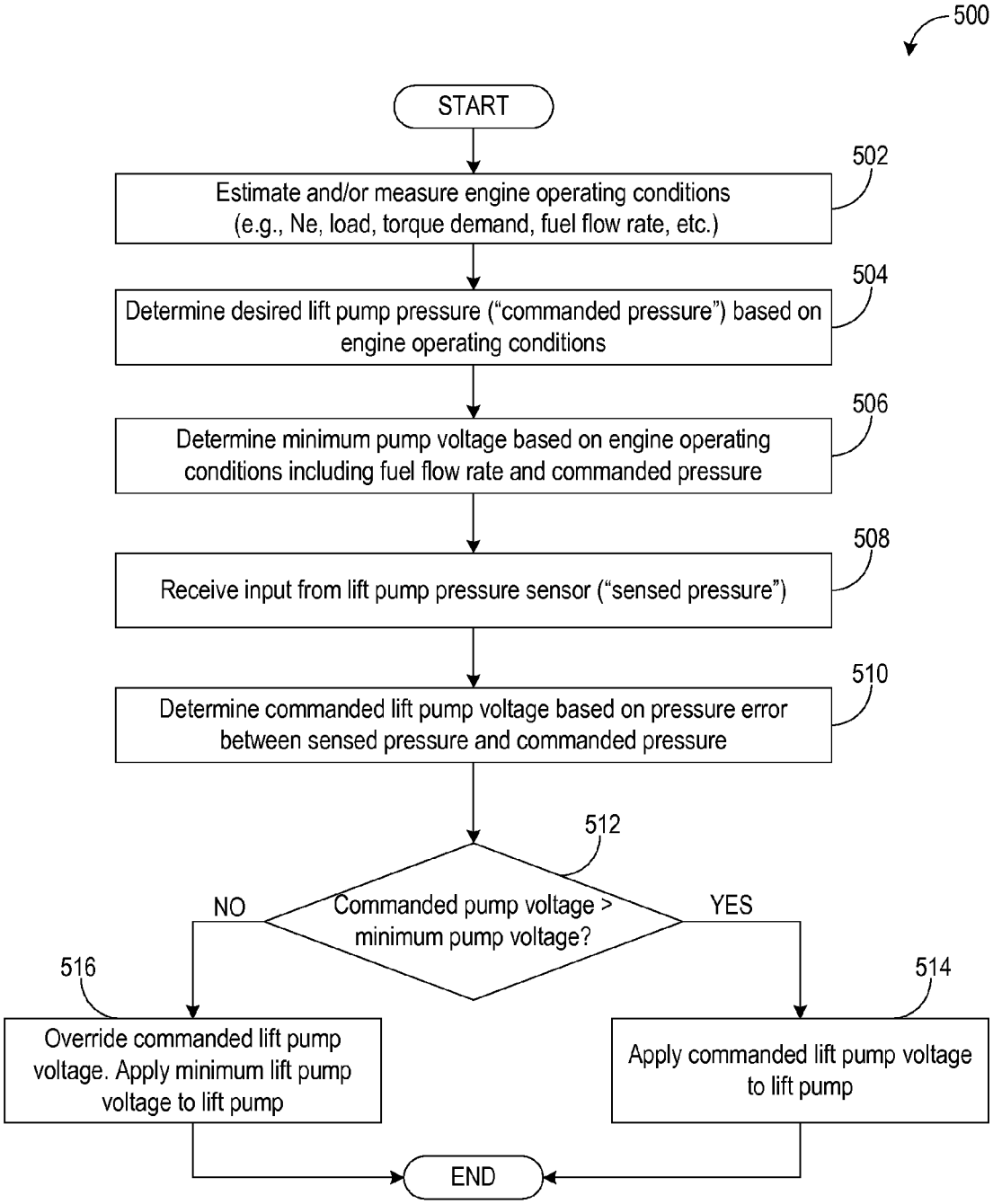
FIG. 5 shows a flowchart illustrating a routine for adjusting the pump command of a fuel system lift pump to maintain at least a minimum pressure downstream of the lift pump and upstream of a high pressure fuel pump.

Now turning to FIG. 5, an example routine 500 is shown for adjusting a lift pump voltage command based on a commanded lift pump pressure, and further in view of a minimum lift pump voltage, to allow a minimum level of lift pump operation to be maintained while the engine is running.

At 502, the routine includes estimating and/or measuring engine operating conditions. These may include, for example, engine speed, load, driver torque demand, fuel flow rate, etc. At 504, based on the estimated engine operating conditions, a desired lift pump pressure may be determined. The desired lift pump pressure may also be referred to herein as the commanded lift pump pressure. As an example, as the engine speed-load increases, the commanded lift pump pressure may also increase (to account for the increased fuel injection that will be required).

At 506, the routine includes determining a minimum pump voltage for the lift pump based on the engine operating conditions. Specifically, the minimum lift pump voltage is determined based on each of the commanded lift pump pressure and the current fuel flow rate. As such, the minimum lift pump voltage maintains the lift pump pressure (that is, the pressure at the outlet of the lift pump and inlet of a downstream fuel injection pump) above fuel vapor pressure.

In some embodiments, the minimum lift pump voltage may be further based on an alcohol content of the fuel lifted by the fuel lift pump. For example, the minimum lift pump voltage may be raised as the vapor pressure of the fuel increases. Industry data exists that shows the effect of both temperature and alcohol-gasoline mixture on vapor pressure.

At 508, the routine includes receiving an input regarding the actual lift pump pressure from a lift pump pressure sensor positioned downstream of the lift pump and upstream of a high pressure fuel injection pump. The output of the lift pump pressure sensor may also be referred to herein as the sensed lift pump pressure and may reflect the fuel pressure at the outlet of the lift pump and inlet of the high pressure pump. As such, the lift pump is configured to deliver fuel from a fuel tank to the high pressure pump, the high pressure pump delivering fuel to fuel injectors.

The routine then moves to adjusting fuel lift pump operation in response to the lift pump pressure sensor. Therein, a pump controller may decrease a lift pump voltage as an output of the pressure sensor increases and increase the lift pump voltage as the output of the pressure sensor decreases. For example, while operating in a pulsed mode, the voltage of the lift pump may be intermittently pulsed based on the sensor output. In another example, while operating in a continuous mode, the voltage of the lift pump may be continuously adjusted based on the sensor output.

At 510, the adjusting of fuel pump operation includes determining a commanded lift pump voltage based on a pressure error between the sensed pressure and the commanded pressure. As elaborated with reference to the control scheme of FIG. 4, the error may be based on a comparison of the output of the lift pump pressure sensor and the desired lift pump pressure, the error fed to a proportional integral derivative (PID) controller. Specifically, if there is a positive error due to the commanded pressure being higher than the sensed pressure, a larger commanded lift pump voltage may be determined. Likewise, if there is a negative error due to the commanded pressure being lower than the sensed pressure, a smaller commanded lift pump voltage may be determined.

At 512, the routine includes comparing the commanded lift pump voltage to the minimum lift pump voltage (previously determined at 506). Specifically, it may be determined if the commanded lift pump voltage is larger than the minimum lift pump voltage. At 514, the routine includes operating the lift pump with the commanded lift pump voltage when the commanded lift pump voltage is above the minimum lift pump voltage. Else, if the commanded lift pump voltage is below the minimum lift pump voltage, at 516, the routine includes operating the lift pump with the minimum lift pump voltage while overriding the commanded lift pump voltage. Herein, the adjustment based on the lift pump pressure sensor output is overridden via the minimum lift pump voltage when the sensor indicates a higher sensed pressure. By enforcing a minimum lift pump voltage when the commanded voltage would otherwise be lower than the minimum voltage, pump operation is preemptively adjusted to account for the possibility of the lift pump pressure sensor having degraded and reading a falsely high pressure. As such, this reduces the risk of the commanded voltage falling below a level where fuel vapors are ingested at the inlet of the high pressure pump, inducing engine stalls.

It will be appreciated that while the routine of FIG. 4 depicts disallowing the lift pump from operating below the minimum lift pump voltage for any duration, in alternate examples, a duration of lift pump operation below the minimum lift pump voltage may be limited. For example, when the commanded lift pump voltage falls below the minimum lift pump voltage, the commanded lift pump voltage may be applied for a duration. Thereafter, if the commanded lift pump voltage continues to remain below the minimum lift pump voltage, the commanded lift pump voltage may be clipped and the minimum lift pump voltage may be applied. This approach may provide marginal power consumption benefits. In other words, pulsed pump operation is still foreseen.

It will be further appreciated that while the routine of FIG. 4 does not depict applying a high voltage side clip that is based on a maximum lift pump voltage, in alternate examples, the controller may also limit lift pump operation above a maximum lift pump voltage. For example, the maximum lift pump voltage may be adjusted based on a pressure set-point of a pressure relief valve coupled between the lift pump and the injection pump. By not intentionally going above the pressure relief point, lift pump electrical power input is minimized. The pump controller may operate the lift pump with the maximum lift pump voltage when the commanded lift pump voltage is above the maximum lift pump voltage (that is, the minimum of the two inputs may be selected). As such, while a transient high lift pump voltage may be advantageously applied to ensure fast pressure response, a continuous high pump voltage may degrade pump performance. In addition, a continuous high pump voltage requirement may be indicative of a fuel system component degradation, such as a fuel tank being out of fuel, a lift pump failure, or a lift pump pressure sensor reading a falsely low pressure. Thus, to enable transient high voltage lift pump operation for fast pressure response while disabling prolonged high voltage lift pump operation, in still further examples, the controller may limit a duration of lift pump operation above the maximum lift pump voltage. For example, when the commanded lift pump voltage rises above the maximum lift pump voltage, the commanded lift pump voltage may be applied. The commanded lift pump voltage may continue to be applied if the commanded lift pump voltage remains above the maximum lift pump voltage for less than a threshold duration. Thereafter, if the commanded lift pump voltage continues to remain above the maximum lift pump voltage for more than the threshold duration, the commanded lift pump voltage may be clipped and the maximum lift pump voltage may be applied.

It will also be appreciated that while the clipping of the commanded lift pump voltage to the minimum voltage is shown occurring during closed-loop lift pump pressure control, including while the pump is operating in the pulsed or continuous mode, in alternate examples, the clipping of the may be selectively performed in response to an indication of degradation of the lift pump pressure sensor, wherein the degradation includes the lift pump pressure sensor reading a false high.

Figure 6:
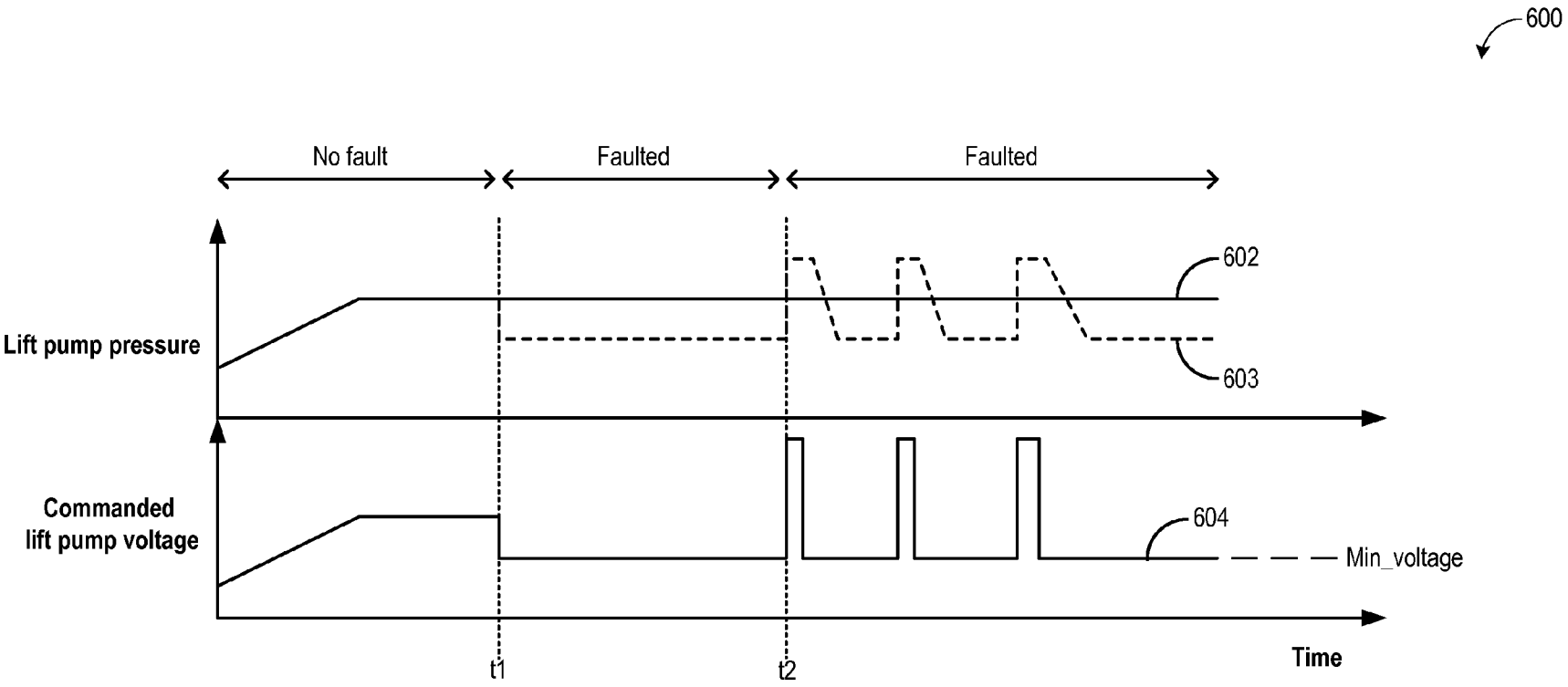
FIG. 6 shows a plot illustrating operation of a fuel system according to the present disclosure to reduce fuel vapor generation at the high pressure fuel pump inlet.
Figure 7:
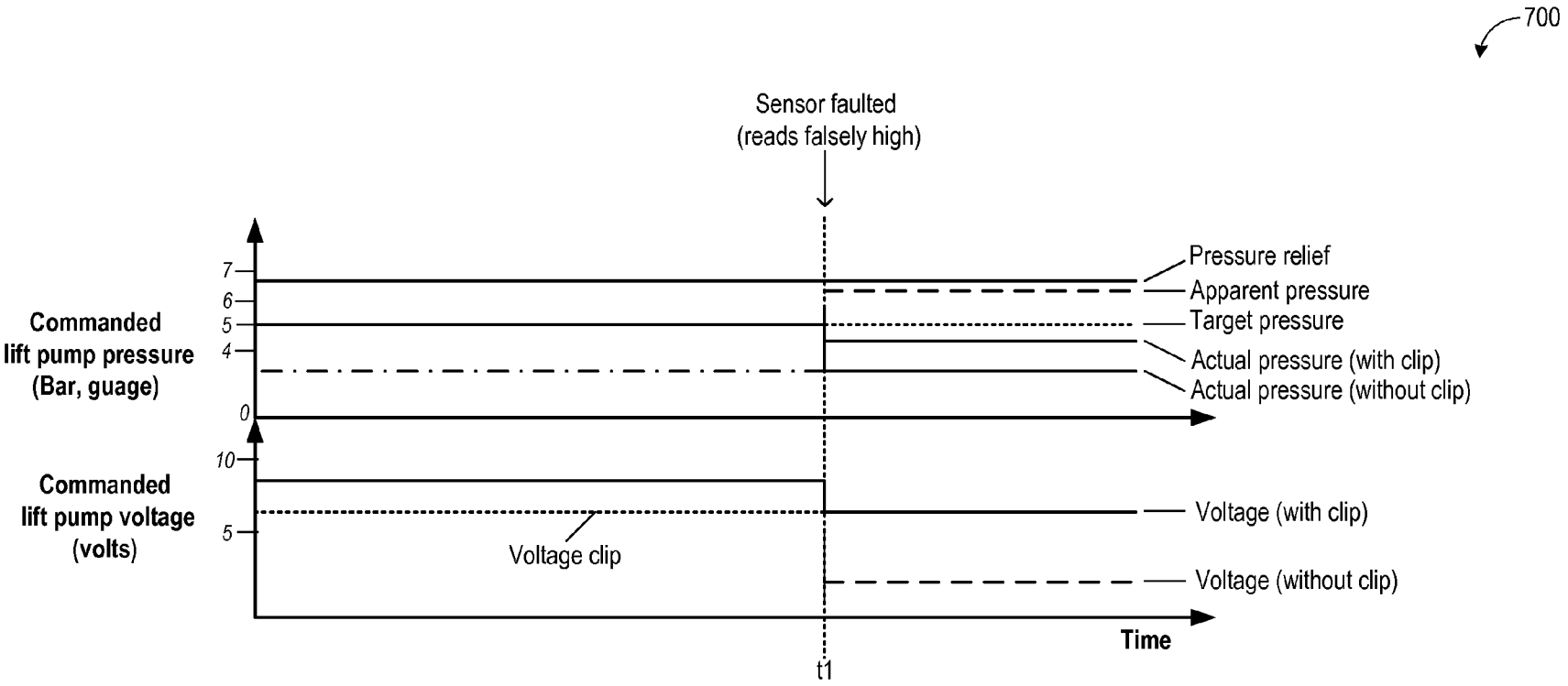
FIG. 7 shows pump pressure behavior before and after a fuel rail pressure sensor fault.

Now turning to FIG. 6, map 600 depicts an example adjustment of a lift pump voltage command in view of a lower clip to reduce the ingestion of fuel vapors at a high pressure pump downstream from the lift pump. Map 600 depicts the commanded lift pump pressure at plot 602 (solid line) relative to the actual lift pump pressure at plot 603 (short dashed line), the commanded lift pump voltage at plot 604, and the minimum lift pump voltage as min_voltage (long dashed line).

Between t0 and t2, the lift pump is operating in a continuous mode, for example, due to engine operation at high speed-load conditions. After t2, the lift pump is operating in a pulsed mode, for example, due to engine operation at low-mid speed-load conditions. Between t0 and t1, the lift pump pressure sensor is not faulted. After t2, the sensor is faulted.

While in the continuous mode, and while the pressure sensor is not faulted, voltage and pressure are monotonically related. There may be some variation between the two due to variations in feedback pressure control.

Once the sensor fault occurs at t1, the actual pressure (plot 603) goes to the feed-forward value which may be below that of what would be the voltage during normal feedback control.

At t2, while the sensor is still faulted, the pump enters a pulsed mode. Herein, the fault still exists, but in this case the actual pump pressure is insufficient to ensure fuel DI pump volumetric efficiency and the low volumetric efficiency is detected and mitigated with a single lift pump voltage pulse as shown. This pulse is then repeated as needed. In between pulses, instead of commanding no pump voltage, the minimum pump voltage is applied, as shown. By maintaining the commanded lift pump voltage at the minimum lift pump voltage between pulses, the frequency of pulses required to maintain the high pressure pump inlet below fuel vapor pressure is reduced, providing power reduction benefits.

In this way, lift pump operation may be adjusted with a lower clip predominately in a continuous voltage mode, but also in a pulsed mode. As such, when operating predominantly in a continuous power lift pump mode, a controller may not apply less voltage than what is known a priori that the fuel system needs while in steady state. In contrast, when operating on pressure feedback alone, the approach may result in insufficient lift pump pressure when the pressure sensor reads falsely high. Thus the pulsing of the lift pump voltage to a high voltage, such as 12 volts for 250 milliseconds upon the detection of vapor or upon the detection of a lowered high pressure direct injection pump volumetric efficiency, may be super-imposed on top of the continuous voltage.

As one non-limiting example, if the continuous voltage minimum was 6 volts at a given operating point, the superimposed pulse may take the voltage up to 12 volts for a duration, such as for 0.2 seconds. As such, in a pure pulsed pump mode, only pump pulses are seen, and in between pulses, the pump voltage is zero. In a pure continuous mode, a pulse is not observed. In the hybrid approach, discussed above at FIG. 6, a minimum voltage is applied. As a result, the pulses are less frequent as compared to the pure pulsed mode. This minimum voltage may be a function of desired pressure and current fuel flow rate. Whenever not enforcing the minimum voltage or pulsing the pump due to a low volumetric efficiency detection event, the lift pump system may operate in closed loop on measured fuel line pressure (that is, lift pump pressure).

Now turning to FIG. 7, map 700 depicts another example adjustment of a lift pump voltage command in view of a lower clip to reduce the ingestion of fuel vapors at a high pressure pump downstream from the lift pump. Map 700 depicts lift pump pressure at the upper plot, and the lift pump voltage at the lower plot. More specifically, FIG. 7 shows the behavior before and after a fuel rail pressure sensor fault. The fault is that the reported fuel rail pressure reads falsely high.

Turning our attention to the topmost graph, we see the maximum actual pressure is set by the pressure relief valve at 6.4 bar gauge. We also see that the minimum actual pressure is set by the fluid's vapor pressure at 4 bar absolute and is shown on the graph as 3 bar gauge. The target pressure, the actual pressure, and the apparent pressure are substantially the same in the un-faulted condition. In the faulted condition, the target pressure remains the same as it was in the un-faulted condition; however, the apparent pressure reads falsely high, causing the actual pressure to drop. Without the minimum voltage clip, the actual pressure falls to the fluid's vapor pressure. With the minimum voltage clip, the actual pressure falls only slightly. Essentially, the system is operating open loop because the feedback term contributes zero in this condition and the feed-forward term sets the voltage.

Turning our attention to the voltage graph, we see that in the un-faulted condition, the pump voltage is at 7 volts, which is above the voltage clip. In the faulted case the feedback pressure sensor reads falsely high. In the case of the prior art where the voltage is unclipped, the feedback term reduces lift pump voltage to a very low amount which is far too low to make sufficient pressure to insure good DI pump volumetric efficiency. When the approach of the present disclosure is applied, the PID term cannot reduce the voltage from the minimum provided by the feed-forward term. While this does result in an actual pressure potentially lower than the target pressure, the target pressure is likely higher than required due to the assumption of maximally volatile fuel. In case the actual pressure is not high enough, a low DI pump volumetric efficiency is detected and the lift pump voltage is pulsed to recover the pressure. As such, this may repeat itself as long as these conditions persist.

In map 700, the sensor reads incorrectly at t1 and is functional prior to t1. Thus, we are able to see the result of the lift pump pressure sensor reading falsely high after t1. As depicted, without the algorithm, the lift pump voltage drops to some small or zero amount such that a lift pump could not cause the actual pressure to go above the vapor pressure point, even if the pump had zero degradation. The lift pump aims to get the lift pump pressure slightly above vapor pressure where over-achieving means excess electrical power consumption. With the algorithm of the present disclosure applied, the lift pump achieves perhaps less pressure than targeted, but under the vast majority of conditions (i.e. fuel volatility), the pressure achieved is sufficient. Specifically, with the algorithm of the present disclosure, pressure feedback control compensates for degraded pump efficiency. Note that the target pressure was selected for the most volatile fuel and where the system encounters less than the most volatile fuel, the system can work properly with an actual pressure lower than target pressure. Pulsing the lift pump when DI pump volumetric efficiency drops below a threshold adds robustness for high volatility fuel.

In one example, a method for a fuel system comprises, pulsing a fuel lift pump responsive to fuel pressure sensed downstream of the lift pump and upstream of a high pressure pump; and applying a larger of a commanded lift pump voltage and a minimum lift pump voltage to the lift pump, the minimum lift pump voltage estimated based on each of a commanded lift pump pressure and a fuel flow rate. The commanded lift pump voltage is estimated based on the commanded lift pump pressure. The method further comprises, applying a smaller of the commanded lift pump voltage and a maximum lift pump voltage to the lift pump when the commanded lift pump voltage remains above the maximum lift pump voltage for longer than a threshold duration, the maximum lift pump voltage estimated based on each of the commanded lift pump pressure and the fuel flow rate. Herein, the applying is responsive to the commanded lift pump voltage being lower than the minimum lift pump voltage for longer than a threshold duration.

In another example, a vehicle fuel system comprises: a fuel tank; a fuel lift pump; an injection pump receiving fuel from the lift pump and delivering fuel to a fuel rail; and a controller. The controller is configured with computer readable instructions stored on non-transitory memory for: receiving a command for lift pump pressure; estimating a commanded lift pump voltage based on the commanded lift pump pressure; estimating a minimum lift pump voltage based on the commanded lift pump pressure and fuel flow rate; and adjusting a voltage applied to the lift pump to the minimum lift pump voltage when the commanded lift pump voltage is lower than the minimum lift pump voltage. Adjusting the voltage when the commanded lift pump voltage is lower than the minimum lift pump voltage includes adjusting when the commanded lift pump voltage has remained lower than the minimum lift pump voltage for a duration. The controller may include further instructions for: operating the fuel lift pump in a continuous mode at higher engine speed-load conditions; and operating the fuel lift pump in a pulsed mode at lower engine speed-load conditions, wherein the adjusting is performed during both the continuous and pulsed mode of operating the lift pump. The system may further comprise a lift pump pressure sensor coupled between an outlet of the fuel lift pump and an inlet of the injection pump. Estimating the commanded lift pump voltage may include estimating the commanded lift pump voltage based on a proportional integral derivative error between the commanded lift pump pressure and an output of the lift pump pressure sensor. The controller may include still further instructions for adjusting the voltage applied to the lift pump to a maximum lift pump voltage when the commanded lift pump voltage is higher than the maximum lift pump voltage for longer than a duration. Herein, the maximum lift pump voltage may be based on a pressure set-point of a pressure relief valve coupled between the lift pump and the injection pump.

In this way, the technical effect of applying a low voltage clip to a lift pump voltage command during closed-loop control of the lift pump is that the lift pump pressure can always be maintained at or above fuel vapor pressure. In doing so, the ingestion of fuel vapors at the inlet of a downstream high pressure injection pump is reduced. By also applying an upper clip to the lift pump voltage, pressure performance is improved without degrading pump durability. By always maintaining the lift performance at or above a minimum level that is adjusted as a function of the commanded lift pump pressure during both continuous and pulsed pump operation, engine performance issues arising from degraded lift pump control due to a lift pump pressure sensor reading a false high can be reduced. Overall, engine stalls are reduced.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system including a lift pump and a high pressure pump, comprising:

while an engine fueled by the fuel system is running, operating the lift pump in a pulsed pump mode, and during operating the lift pump in the pulsed pump mode while the engine is running:

determining a commanded lift pump pressure based on engine operating conditions;

determining a commanded lift pump voltage based on the determined commanded lift pump pressure and a fuel pressure sensed downstream of the lift pump and upstream of the high pressure pump during operating the lift pump;

determining a minimum lift pump voltage based on each of the determined commanded lift pump pressure and a current fuel flow rate; and applying a larger of the determined commanded lift pump voltage and the determined minimum lift pump voltage to the lift pump, including pulsing the lift pump with the plurality of pulses.

2. The method of claim 1, further comprising, during operation of the lift pump in the pulsed pump mode while the engine is running, and while the determined commanded lift pump voltage is larger than the determined minimum lift pump voltage, determining a maximum lift pump voltage based on each of the determined commanded lift pump pressure and the current fuel flow rate; and in response to the determined commanded lift pump voltage exceeding the determined maximum lift pump voltage for longer than a threshold duration, applying the determined maximum lift pump voltage to the lift pump, including pulsing the lift pump with the plurality of pulses.

3. The method of claim 1, further comprising, during operation of the lift pump in the pulsed pump mode while the engine is running, applying the determined minimum lift pump voltage to the lift pump responsive to the determined commanded lift pump voltage being lower than the determined minimum lift pump voltage for longer than a threshold duration.

4. The method of claim 1, wherein the determined minimum lift pump voltage maintains lift pump pressure above fuel vapor pressure at the current fuel flow rate and determined commanded lift pump pressure.

5. The method of claim 1, wherein the determined minimum lift pump voltage is further based on an alcohol content of fuel lifted by the lift pump, the determined minimum lift pump voltage raised as the alcohol content of the fuel increases.

6. The method of claim 1, wherein the determined commanded lift pump voltage is determined based on an error between the fuel pressure sensed downstream of the lift pump and upstream of the high pressure pump during operating the lift pump and the determined commanded lift pump pressure.

7. The method of claim 2, wherein the determined maximum lift pump voltage is determined based on a pressure set-point of a pressure relief valve coupled between the lift pump and the high pressure pump.

* * * * *